US009707142B2

(12) United States Patent
Lachenbruch et al.

(10) Patent No.: US 9,707,142 B2
(45) Date of Patent: Jul. 18, 2017

(54) OCCUPANT SUPPORT AND METHOD FOR POSITIONING AN OCCUPANT ON THE OCCUPANT SUPPORT

(75) Inventors: Charles A. Lachenbruch, Lakeway, TX (US); Rachel Williamson, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 685 days.

(21) Appl. No.: 13/039,409

(22) Filed: Mar. 3, 2011

(65) Prior Publication Data

US 2012/0222214 A1 Sep. 6, 2012

(51) Int. Cl.

| | |
|---|---|
| ***A61G 7/057*** | (2006.01) |
| ***A61G 7/00*** | (2006.01) |
| ***A61G 7/015*** | (2006.01) |
| *A61G 7/005* | (2006.01) |
| *A61G 7/018* | (2006.01) |

(52) U.S. Cl.

CPC ..... *A61G 7/05776* (2013.01); *A61G 7/001* (2013.01); *A61G 7/015* (2013.01);

(Continued)

(58) Field of Classification Search

CPC .... A61G 7/05776; A61G 7/001; A61G 7/015; A61G 7/005; A61G 7/018; A61G 2203/42; A61G 2203/34; A61G 2203/32

(Continued)

(56) References Cited

U.S. PATENT DOCUMENTS 4,941,221 A * 7/1990 Kanzler ..... 5/615
5,170,364 A * 12/1992 Gross et al. ..... 702/139

(Continued)

FOREIGN PATENT DOCUMENTS

| | | |
|---|---|---|
| JP | 2009500131 A | 1/2009 |
| JP | 2009517103 A | 4/2009 |
| WO | 2007008830 A2 | 1/2007 |

OTHER PUBLICATIONS

Response to May 24, 2016 Office Action for JP2012-047269; response mailed to JPO Jul. 20, 2016.

(Continued)

*Primary Examiner* — Nicholas Polito

(74) *Attorney, Agent, or Firm* — Kenneth C. Baran

(57) ABSTRACT

A method of positioning an occupant (98) of a bed includes identifying (204) the presence of a discrepancy between an existing occupant position and a target occupant position, and establishing (206) an elevation gradient having a direction, magnitude and position compatible with moving the occupant from the existing occupant position to the target position. In one variant of the method the step of establishing an elevation gradient is one substep of a preordained sequence of bladder inflations and deflations. In another variant, the method includes determining (210) if the discrepancy has been corrected and responding to any noncorrection of the discrepancy. An associated bed (20) includes a mattress (82) at least one layer (100) of repositioning bladders (102, 104, 106, 108) a sensor array (130) a controller (140) and a pump (142). The controller is capable of receiving information from the sensor array (130) identifying (204) suboptimal positioning of the occupant as a function of the received information and also capable of issuing commands in response to the identification of suboptimal positioning, in particular commands for the pump (142) to inflate selected repositioning bladders, thereby urging the occupant from his or her existing position to the target position.

12 Claims, 15 Drawing Sheets

(52) U.S. Cl.
CPC ..... *A61G 7/005* (2013.01); *A61G 7/018* (2013.01); *A61G 2203/32* (2013.01); *A61G 2203/34* (2013.01); *A61G 2203/42* (2013.01)

(58) Field of Classification Search
USPC ..... 5/613–619, 706, 710, 713, 715, 655.3
See application file for complete search history.

(56) References Cited

U.S. PATENT DOCUMENTS

| | | | | |
|---|---|---|---|---|
| 5,561,875 | A * | 10/1996 | Graebe | 5/423 |
| 7,251,845 | B2 * | 8/2007 | Schaller et al. | 5/613 |
| 7,343,189 | B2 | 3/2008 | Kagermeier et al. | |
| 7,716,767 | B2 | 5/2010 | Bohm et al. | |
| 7,883,478 | B2 * | 2/2011 | Skinner et al. | 600/595 |
| 2003/0159219 | A1 | 8/2003 | Harrison et al. | |
| 2008/0313816 | A1 | 12/2008 | Bohm et al. | |

OTHER PUBLICATIONS

English Translation of Amended Claims in response to May 24, 2016 Office Action for JP2012-047269; response mailed to JPO Jul. 20, 2016.
Office Action for JP2012-047269; Mailing Date May 24, 2016.
English Translation of Office Action for JP2012-047269; Mailing Date May 24, 2016.
Office Action Response for JP2012-047269; Mailed Feb. 10, 2016.
Amended Claims—Response to Office Action for JP2012-04269; Mailed Feburary 10, 2016.
Office Action for JP2012-047269; Mailing Date Nov. 24, 2015; Mailing No. 529487.
European Search Report for EP Application 12157045.1; mailed May 9, 2014; received May 12, 2014; Place of Search—The Hague; Date of Completion of the Search—Apr. 24, 2014.
EP Search Report Response for EP Application 12157045.1, Dec. 8, 2014.
Claims 1 to 15, EP Application 1215045.1, Track Changes.
Claims 1 to 15, EP Application 1215045.1, Clean Copy.
Amended Description pp. 14, 15, 16 and 17 to 20, EP Application 1215045.1, Track Changes.
Amended Description pp. 14, 15, 16 and 17 to 20, EP Application 1215045.1, Clean Copy.
Amended Description pp. 1 and 2, EP Application 1215045.1, Clean Copy.
Amended Description pp. 1 and 2, EP Application 1215045.1, Track Changes.
Decision of Rejection—JP Application 2012-247269; Jan. 10, 2017.
Decision of Rejection—JP Application 2012-247269; Jan. 10, 2017—English Translation.

* cited by examiner

OCCUPANT SUPPORT AND METHOD FOR POSITIONING AN OCCUPANT ON THE OCCUPANT SUPPORT

TECHNICAL FIELD

The subject matter described herein relates to occupant supports, such as hospital beds, which are operable to reposition an occupant of the occupant support and to an associated method of occupant repositioning.

BACKGROUND

Hospital beds typically comprise a frame extending longitudinally from a head end to a foot end and laterally from a left side to a right side, and a deck affixed to the frame. The deck may be a segmented deck having one or more sections whose angular orientation is adjustable by pivoting the deck section about a laterally extending axis. For example the deck may have a torso section positionable between angular orientations of 0° to 65° relative to the frame. A mattress rests on the deck. The mattress may be constructed of foam, inflatable bladders or a combination of foam and inflatable bladders and exhibits enough flexibility to conform to the profile defined by the orientation adjustable deck sections. The bed may also include a pair of turn assist bladders, one on each side of the longitudinal centerline of the bed. The turn assist bladders are deflated when not in use.

A bed occupant or a caregiver may operate the bed to change the angular orientation of one of the adjustable deck sections and the corresponding portion of the mattress. In addition, the caregiver may inflate one or the other of the turn assist bladders to tilt the occupant to the left or right thereby assisting in efforts to turn the occupant from, for example, a prone position to a supine position. The caregiver may also use the turn assist bladders to apply various therapeutic or preventive treatments. One example of such a treatment is Continuous Lateral Rotation Therapy (CLRT). CLRT involves slowly inflating and deflating the turn assist bladders out of phase with each other in order to gently turn the bed occupant alternately to the left and right by about 20°-45° in each direction. The alternate turning helps resist fluid accumulation in the occupant's lungs, mobilizes secretions already present in the lungs, and increases aeration of the lungs. Another example treatment is Lateral Pressure Relief (LPR) which involves a similar left to right cycling of about 10° to guard against the onset of decubitus ulcers.

Experimental evidence suggests that turn assist, CLRT and LPR are most effective if the occupant is laterally centered on the mattress and lying substantially parallel to the longitudinal direction before inflation of the underlying turn assist bladder begins. Otherwise inflation of the turn assist bladder may simply elevate the occupant rather than turn or tilt him. Accordingly, it is desirable to develop systems and methods for prepositioning a mispositioned occupant, particularly in the lateral direction, prior to initiating turn assist, CLRT, LPR or other lateral rotations. Such systems and methods may also be useful in prepositioning an occupant, particularly in the longitudinal direction, prior to changing the orientation of the orientation adjustable deck sections, such as the torso section.

SUMMARY

A method of positioning an occupant of a bed includes identifying the presence of a discrepancy between an existing occupant position and a target occupant position, and establishing an elevation gradient having a direction, magnitude and position compatible with moving the occupant from the existing occupant position to the target position. In one variant of the method the step of establishing an elevation gradient is one substep of a preordained sequence of bladder inflations and deflations. In another variant, the method includes determining if the discrepancy has been corrected and responding to any noncorrection of the discrepancy. An associated bed includes a mattress, at least one layer of repositioning bladders, a sensor array, a controller and a pump. The controller is capable of receiving information from the sensor array, identifying suboptimal positioning of an occupant of the occupant support as a function of the received information and also capable of issuing commands in response to the identification of suboptimal positioning, in particular commands for the pump to inflate selected repositioning bladders.

BRIEF DESCRIPTION OF THE DRAWINGS

The foregoing and other features of the various embodiments of the occupant support and positioning method described herein will become more apparent from the following detailed description and the accompanying drawings in which.

DETAILED DESCRIPTION

Figures 1, 1A:
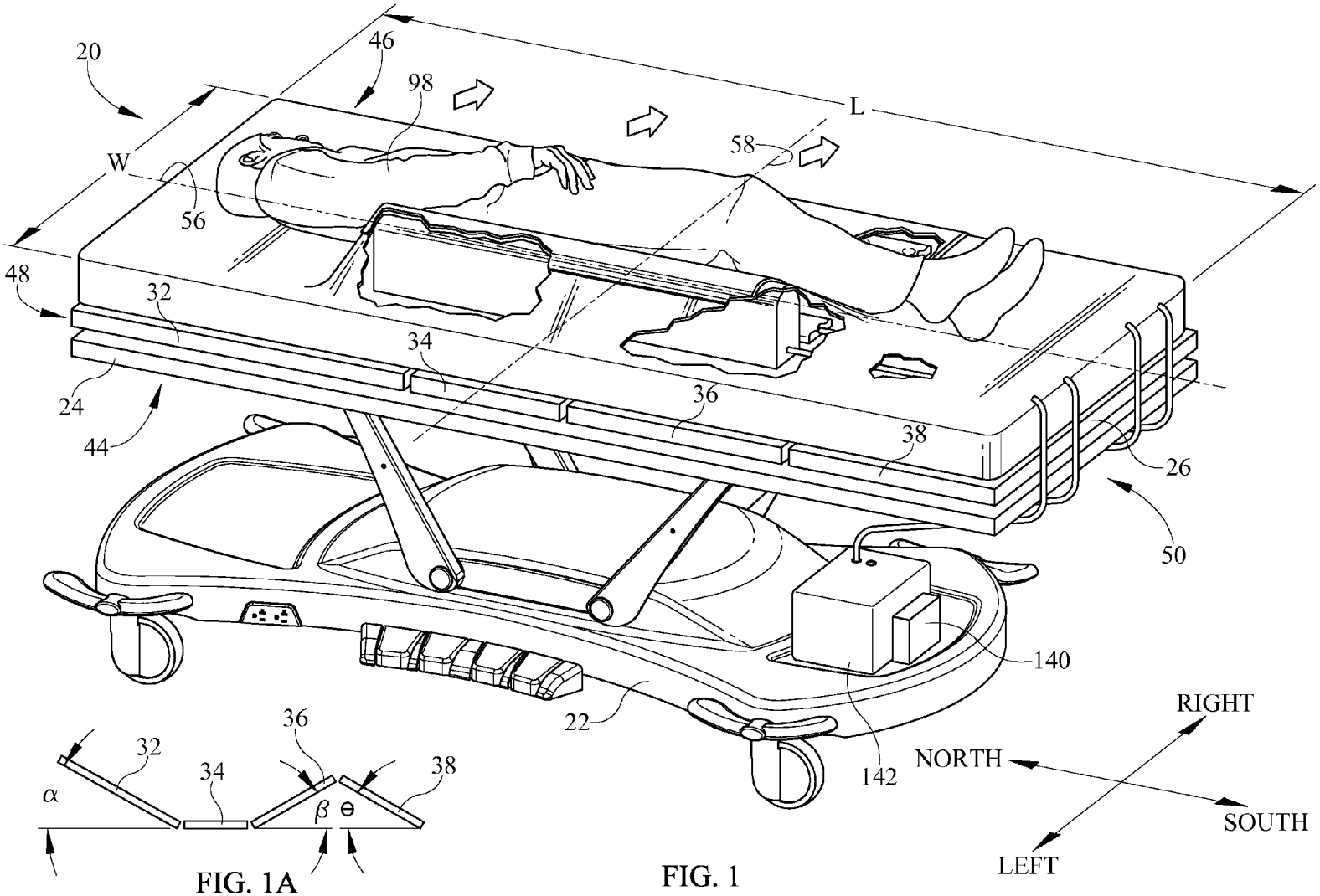
FIGS. 1 and 1A are a perspective view and a schematic side elevation view respectively of an occupant support, exemplified by a hospital bed, with an occupant lying on a mattress thereof and with portions of the mattress broken away to reveal a layer of longitudinally extending repositioning bladders, one of which is in an inflated state.
Figure 2:
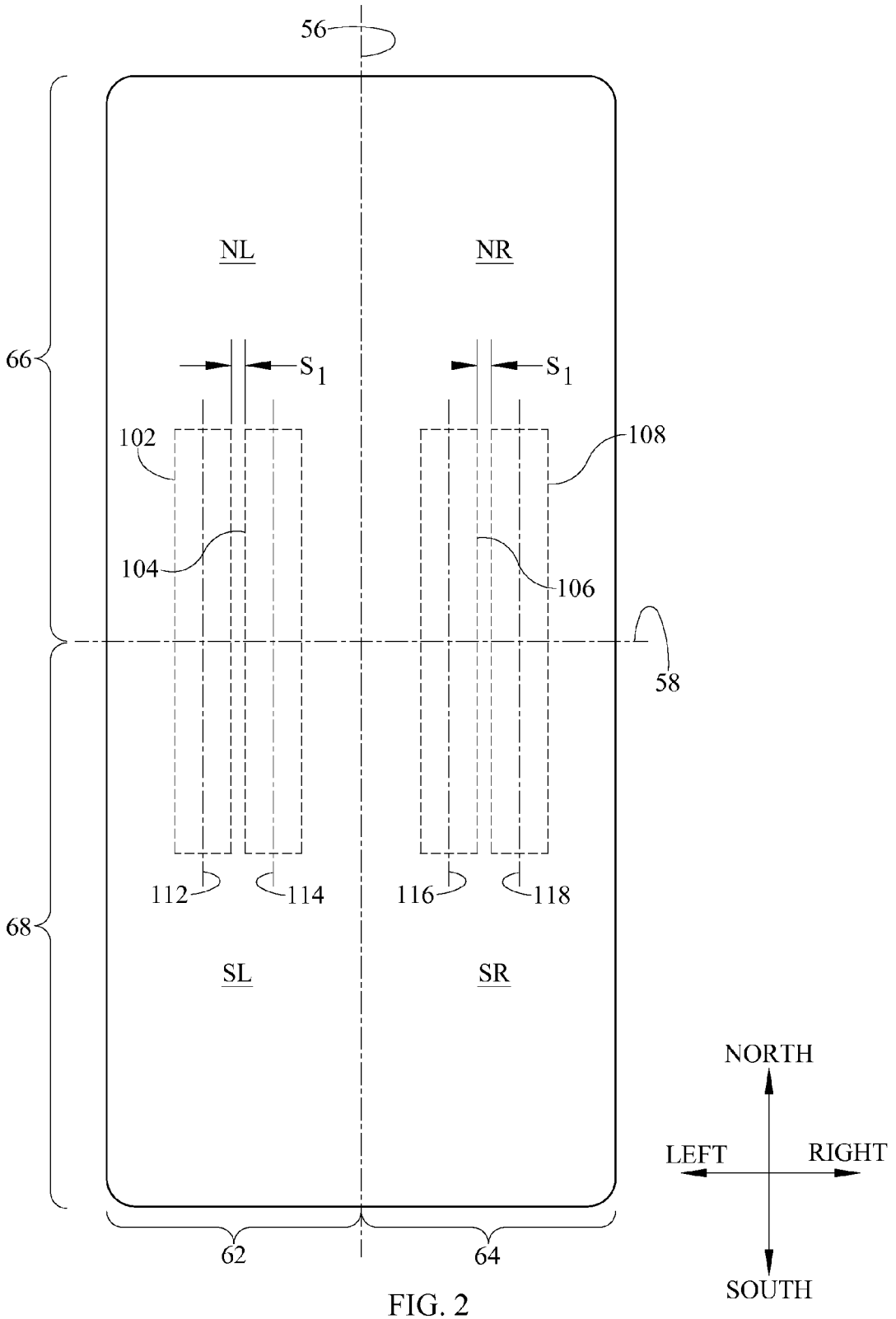
FIG. 2 is a plan view of the bed of FIG. 1 showing the positions and orientations of the bladders.

Referring to FIGS. 1, 1A and 2 an occupant support exemplified by a hospital bed 20 comprises a base frame 22, an elevatable frame 24 supported on the base frame, and a deck 26 supported on the elevatable frame. The illustrated deck is a segmented deck comprising a torso or upper body section 32, a seat section 34, a thigh section 36 and a calf section 38. The angular orientations α, β, θ of the upper body, seat and deck sections is adjustable. The bed extends laterally from a left side 44 to a right side 46 and longitudinally from a head end 48 to a foot end 50. In the present application, the terms "left" and "right" are from the perspective of an observer at the foot of the bed looking headwardly. The illustration also shows longitudinally and laterally extending centerlines 56, 58. The longitudinal centerline defines laterally adjacent left and right sectors 62, 64. The lateral centerline defines longitudinally adjacent head and foot sectors, 66, 68, which are also referred to as north and south sectors. Collectively, the two centerlines define four regions, a north left region NL, a north right region NR, a south left region SL, and a south right region SR. Because the sectors and regions are defined by centerlines, sectors 62, 64 are laterally adjacent halves, sectors 66, 68 are longitudinally adjacent halves, and regions NL, NR, SL, SR are equally sized quadrants.

Referring additionally to FIGS. 3, 4, 5A, and 5B the bed also includes a mattress assembly 80 comprising a base mattress 82 resting on deck 26. The base mattress has left, right, head and foot edges 86, 88, 92, 94. The base mattress exhibits enough flexibility to conform to the profile defined by the orientation adjustable deck sections, e.g. to the profile of FIG. 1A. Various mattress constructions may be used. These include but are not limited to mattresses that employ foam, inflatable bladders, or a combination of foam and inflatable bladders. The bed also includes a pair of turn assist bladders, not visible, one on each side of the longitudinal centerline, between the deck 26 and base mattress 82. One of the turn assist bladders is inflated to apply one of the lateral rotations described above (turn assist, CLRT, LPR). The turn assist bladders are deflated when not in use.

The mattress assembly also includes at least one layer 100 of inflatable and deflatable repositioning bladders intended for lateral repositioning of a bed occupant 98 in preparation for occupant lateral rotation by the turn assist bladders. Bladder layer 100 includes a laterally outboard left bladder 102, a laterally inboard left bladder 104, a laterally inboard right bladder 106 and a laterally outboard right bladder 108, each having a longitudinally extending bladder centerline 112, 114, 116, 118. Bladder 102 is depicted in an inflated state. Bladders 104, 106, 108 are depicted as deflated. The deflated bladders are shown as projecting slightly above the surface of layer 100, but in practice would be substantially flush with the surface. For a base mattress having a length L of 80 inches (203 cm) and a width W of 36 inches (91 cm), each bladder has a length L1 of at least about 30 inches (76 cm) and is located so that its longitudinal ends are about equidistant from the head and foot edges 92, 94 of the base mattress. Each bladder has a width W1 less than the width of the turn assist bladders. The illustrated bladders have a width of about 4 inches (10 cm) and, when fully inflated, a height H1 of about 14.6 inches (37 cm). Accordingly, the working aspect ratio of each fully inflated bladder is about 3.65. The laterally outboard bladders 102, 108 are positioned with their centerlines 112, 118 about 6.8 inches (17 cm) from the respective left and right edges 86, 88 of the base mattress. Laterally inboard bladders 104, 106 are positioned immediately inboard of the outboard bladders. In the illustrated bed the centerline of each inboard bladder is about 3 inches (7.6 cm) inboard of the neighboring outboard bladder, leaving about a 1 inch (2.5 cm) space S1 between each inboard/outboard bladder pair. The repositioning bladders are illustrated as a non-integral component of the mattress assembly but could also be a feature built in to the top of base mattress 82.

The mattress assembly also includes a sensor array 130 comprising a blanket 132 and an array of pressure or force sensors 134 installed on the blanket. The sensor array is positioned above the bladder layer 100 where it will be in close proximity to the bed occupant and with an equal number of sensors in each region NL, NR, SL, SR.

The bed also includes a controller 140, for example a microprocessor, and an air pump 142 for inflating or deflating the turn assist bladders. The controller is capable of receiving information from the sensor array, specifically signals indicating the force or pressure applied to the sensors. The controller is also capable of identifying suboptimal positioning of an occupant of the occupant support as a function of the received information and is also capable of issuing commands to the pump in response to the identification of suboptimal positioning. The pump responds to the issued command by inflating or deflating selected repositioning bladders.

Figure 6:
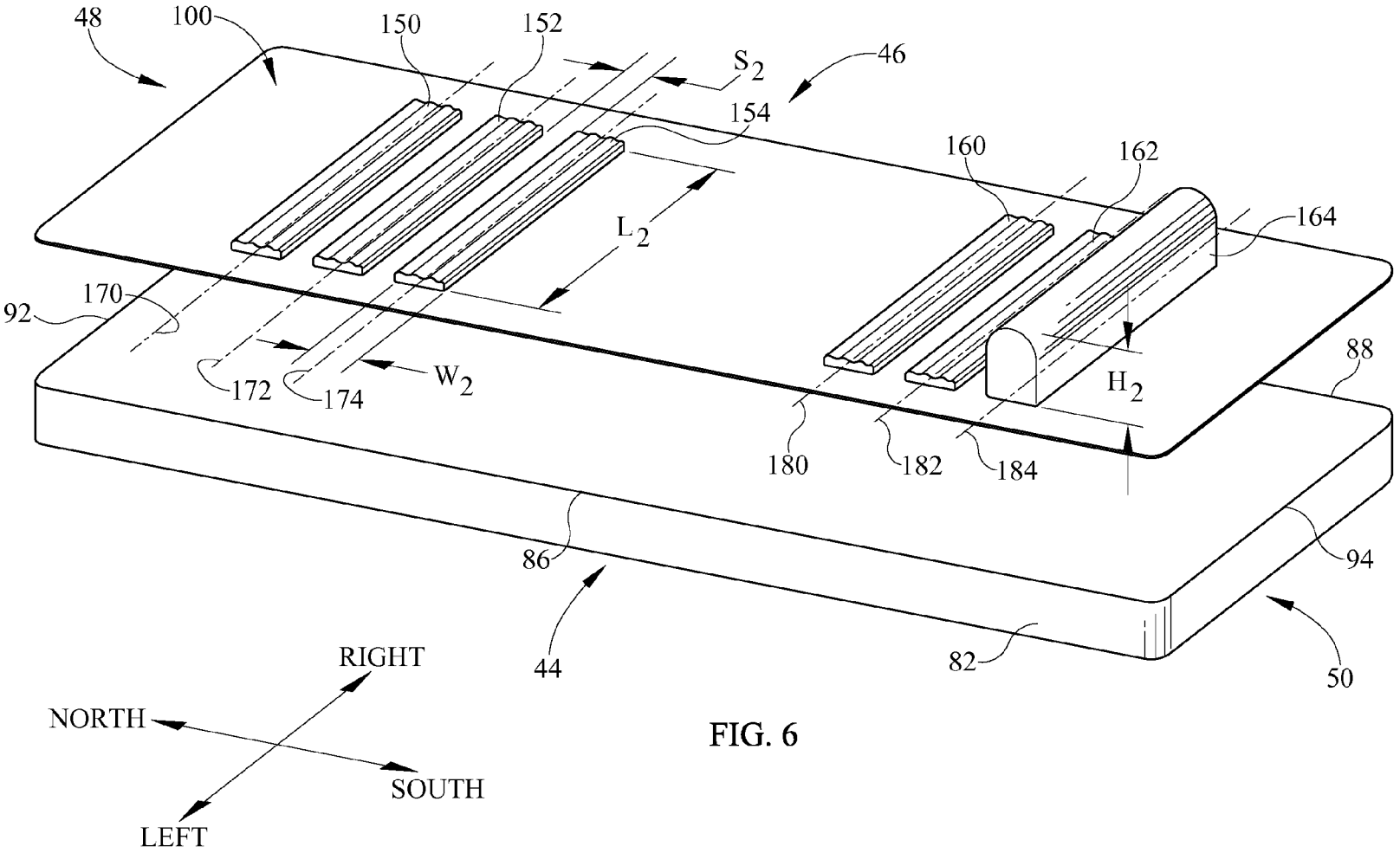
FIG. 6 is an exploded perspective view similar to that of FIG. 3 showing a mattress and a bladder array comprising laterally extending repositioning bladders.
Figure 7:
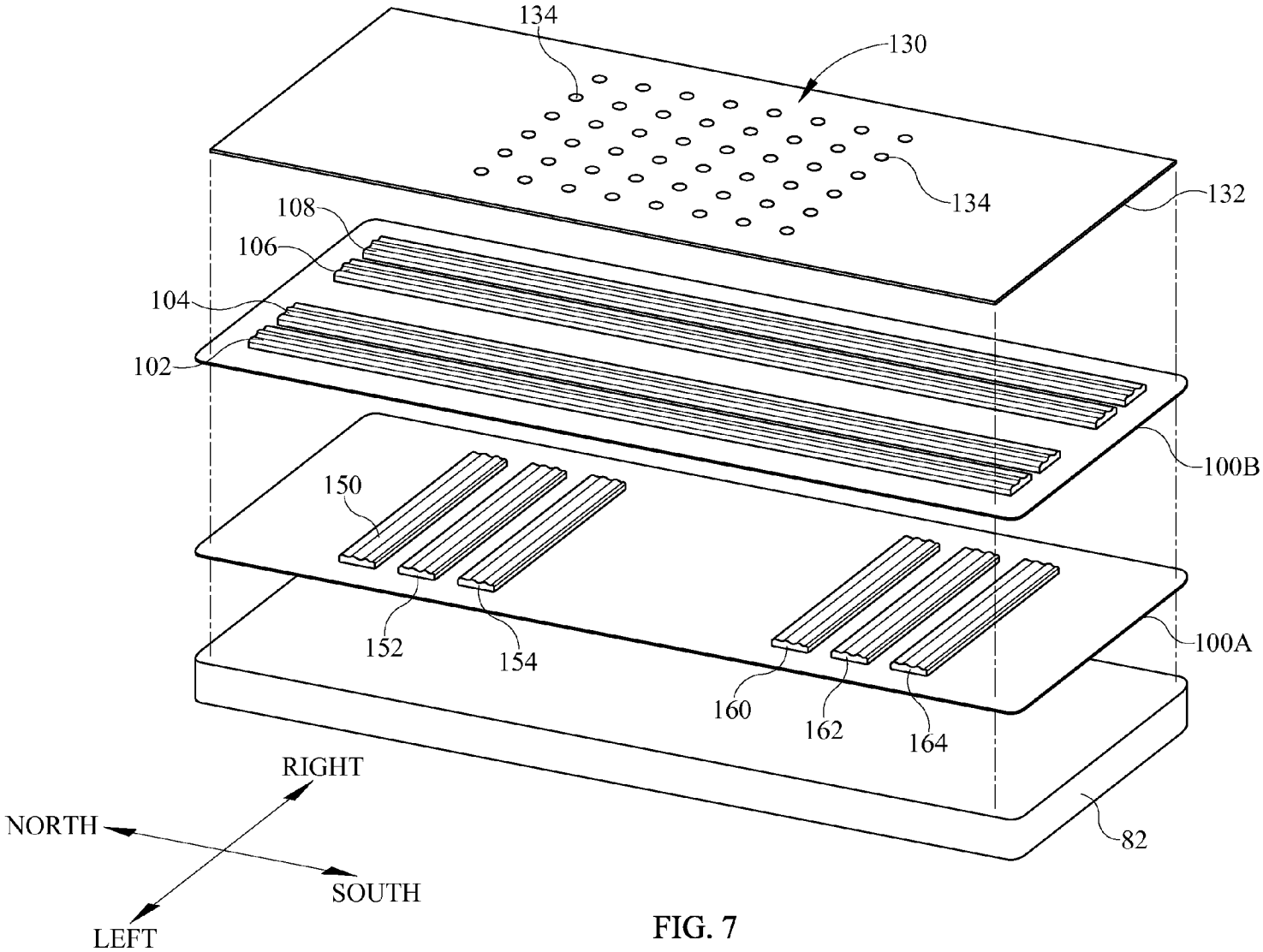
FIG. 7 is a view similar to that of FIGS. 3 and 6 showing a mattress, a layer of longitudinally extending repositioning bladders, a layer of laterally extending repositioning bladders, and a sensor array.
Figures 8A, 8B, 8C:
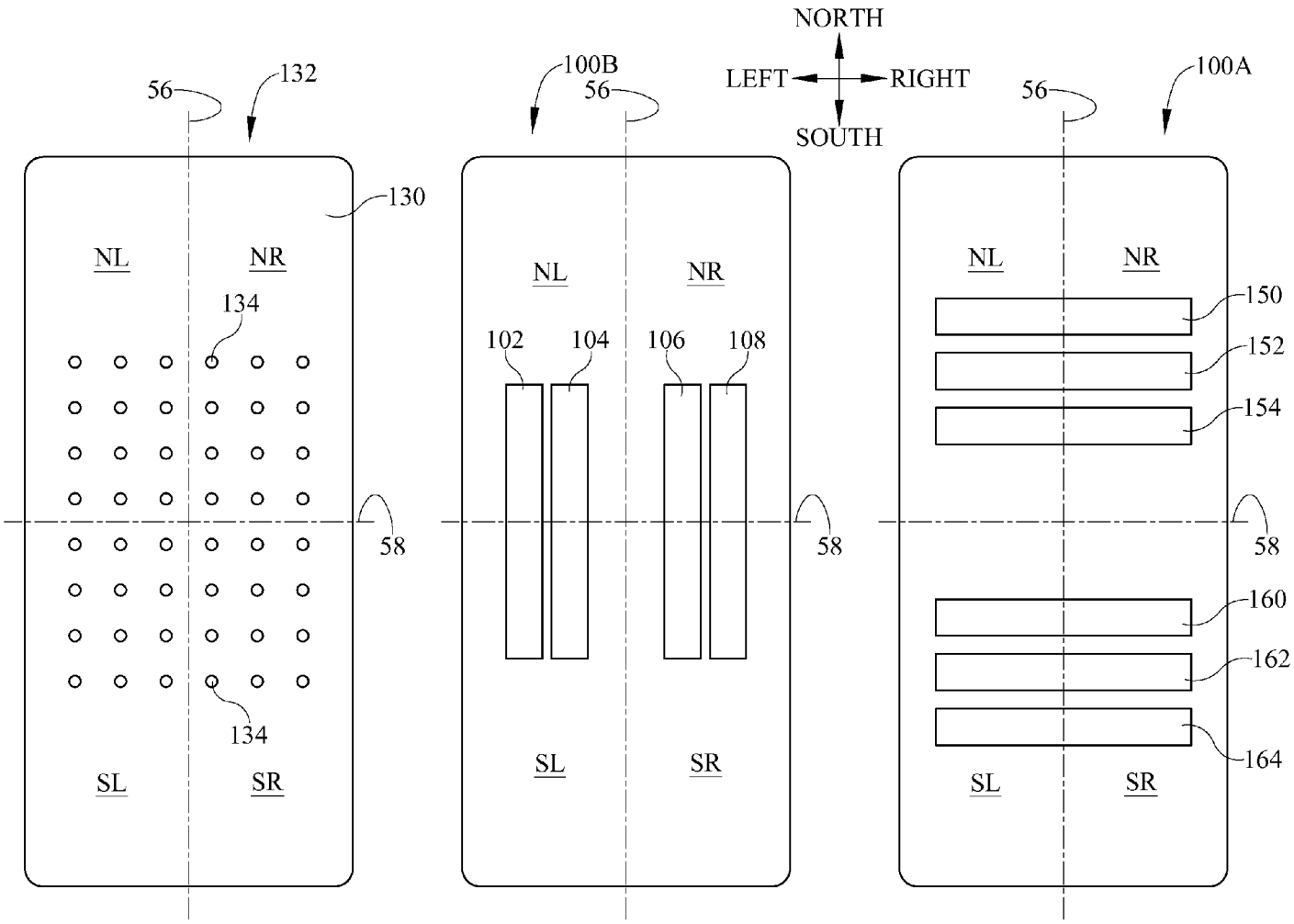
FIG. 8 is a plan view showing the bladder arrays and sensor array of FIG. 7.

Referring to FIG. 6, another variant of the bed comprises a mattress assembly with a bladder layer 100 that includes a longitudinally outboard north bladder 150, a longitudinally medial north bladder 152, a longitudinally inboard north bladder 154, and longitudinally inboard, medial and outboard south bladders 160, 162, 164. Each bladder has a laterally extending bladder centerline 170, 172, 174, 180, 182, 184. The laterally extending bladders are intended for longitudinal repositioning of a bed occupant. As previously noted longitudinal repositioning may be desirable prior to changing the elevation of the upper torso section of the deck and of the corresponding portion of the mattress. For a base mattress having a length L of 80 inches (203 cm) and a width W of 36 inches (91 cm), each bladder has a length L2 of at least about 28 inches (71 cm) and is located so that its lateral ends are about equidistant from the left and right edges 86, 88 of the base mattress. Each bladder has a width W2 of about 4 inches (10 cm) and, when fully inflated, a height H2 of about 14.6 inches (37 cm). Accordingly, the working aspect ratio of each fully inflated bladder is about 3.65. The interbladder separation S2 is about 2 inches (5 cm). The longitudinally outboard most edge of outboard bladders 150, 164 is about 17.5 inches (44 cm) from the respective head and foot edges 92, 94. The repositioning bladders are illustrated as a non-integral component of the mattress assembly but could also be a feature built in to the top of base mattress 82.

FIGS. 7 and 8A-8C show another bed variant featuring a bladder layer 100A with laterally extending repositioning bladders and a layer 100B with longitudinally extending repositioning bladders. The vertical order of layers 100A, 100B may be opposite that shown in the illustration. The dual layers impart both lateral and longitudinal repositioning capability to the bed.

Figure 9:
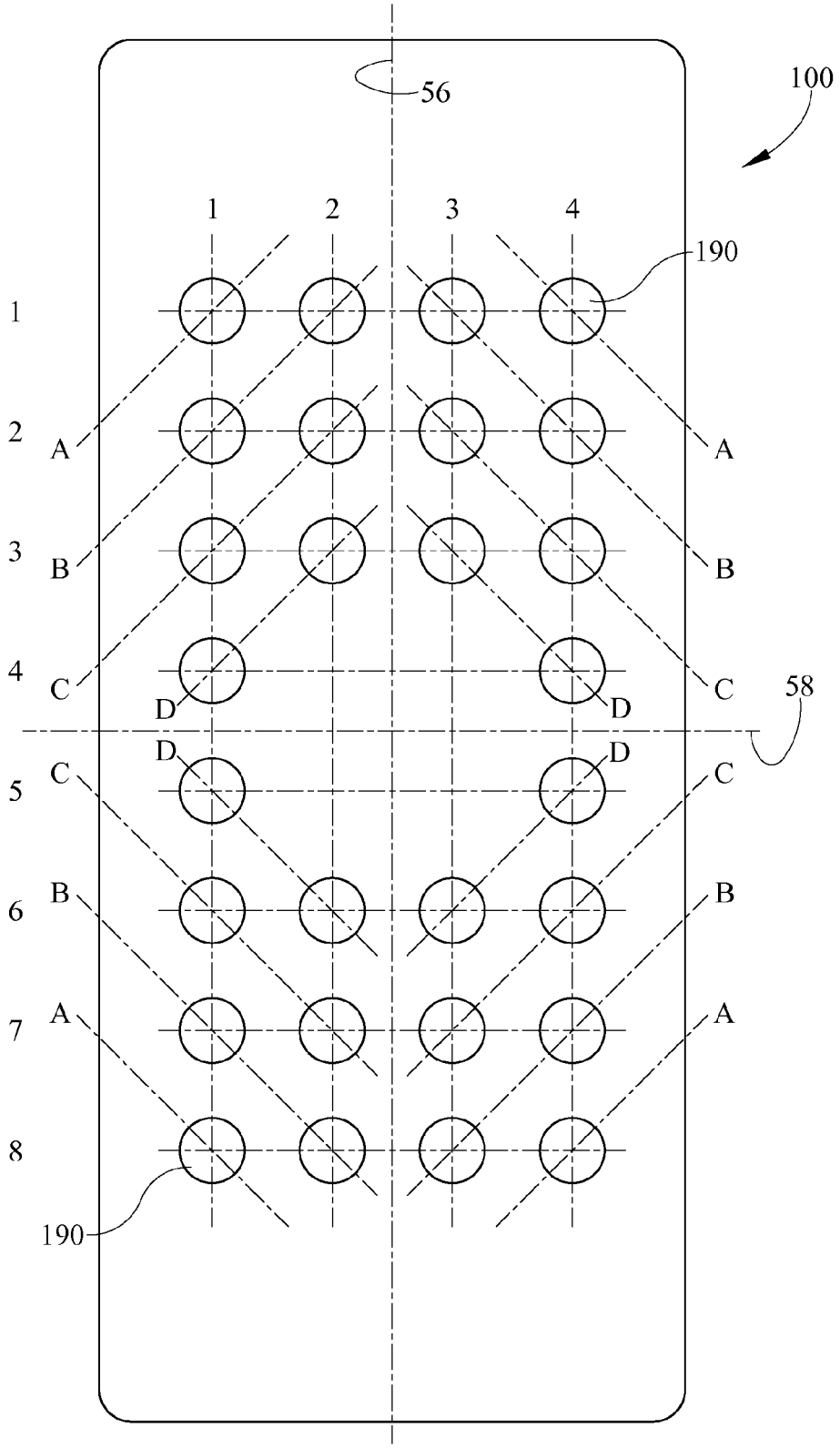
FIG. 9 is a plan view showing a variant in which the bladder layer is matrix of cylindrical bladders.
Figure 10:
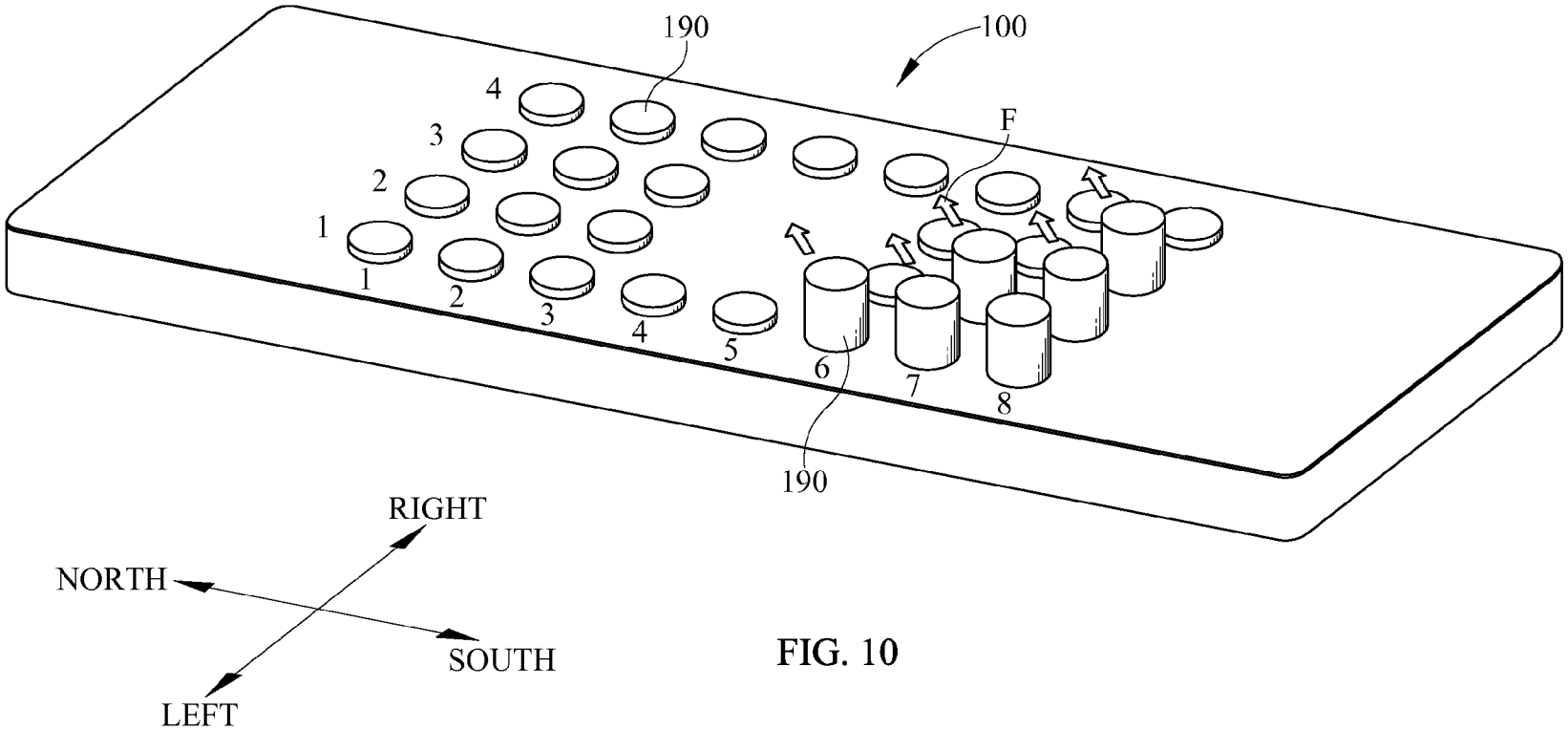
FIG. 10 is a perspective view showing the matrix layer of FIG. 9 with selected bladders inflated to urge a bed occupant in direction F.

FIGS. 9-10 show another bed variant in which bladder layer 100 comprises a laterally and longitudinally extending matrix of inflatable and deflatable cells 190. For reference each cell is individually identified with row and column coordinates and selected cells are grouped together in groups identified by letters A, B, C, D. A longitudinally extending cell column can be inflated to reposition an occupant laterally. A laterally extending cell row can be inflated to reposition an occupant longitudinally. In addition, as seen in FIG. 10, selected cells which, in general, are not all in the same row or column, can be inflated to reposition an occupant in a direction, such as direction F, having both longitudinal and lateral components. Such occupant repositioning could be accomplished by inflating one or more of the lettered cell groups.

Figure 11:
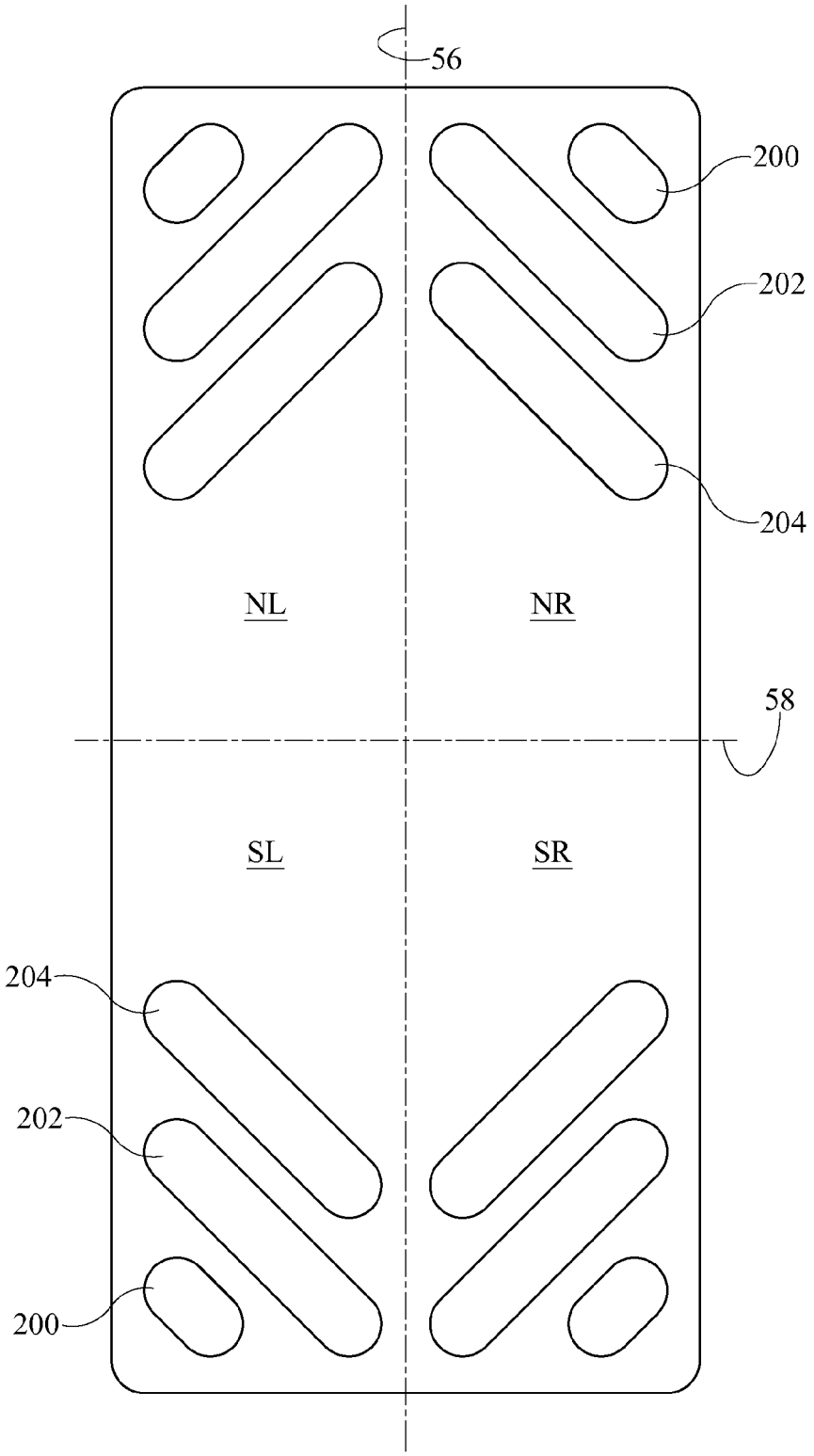
FIG. 11 is a plan view of another variant having obliquely oriented groups of bladders.

FIG. 11 shows another variant with triplets of obliquely oriented bladders 200, 202, 204 in each of the four regions NL, NR, SL, SR.

Referring back to FIGS. 1-5 by way of example, in operation, controller 140 identifies a discrepancy between an existing occupant position and a target occupant position which is more favorable for lateral turning of the occupant. Typically the target position is one in which the occupant's center of gravity is aligned with longitudinal axis 56, is aligned with lateral axis 58 or offset from it by some predesignated distance, and in which the occupant lies approximately parallel to the longitudinal centerline. The discrepancy identification is carried out with the readings from the on-board sensor array 130 which allow the controller to assess the spatial distribution of loading on the base mattress or to otherwise identify an overloaded portion of the mattress. As used herein "overloaded" refers to a condition in which a portion of the bed, for example one or more of regions NL, NR, SL, SR, is carrying disproportionately more load than would be expected if the occupant were in a favorable position for lateral turning, not an exceedance of the weight limits applicable to the bed.

Figure 12:
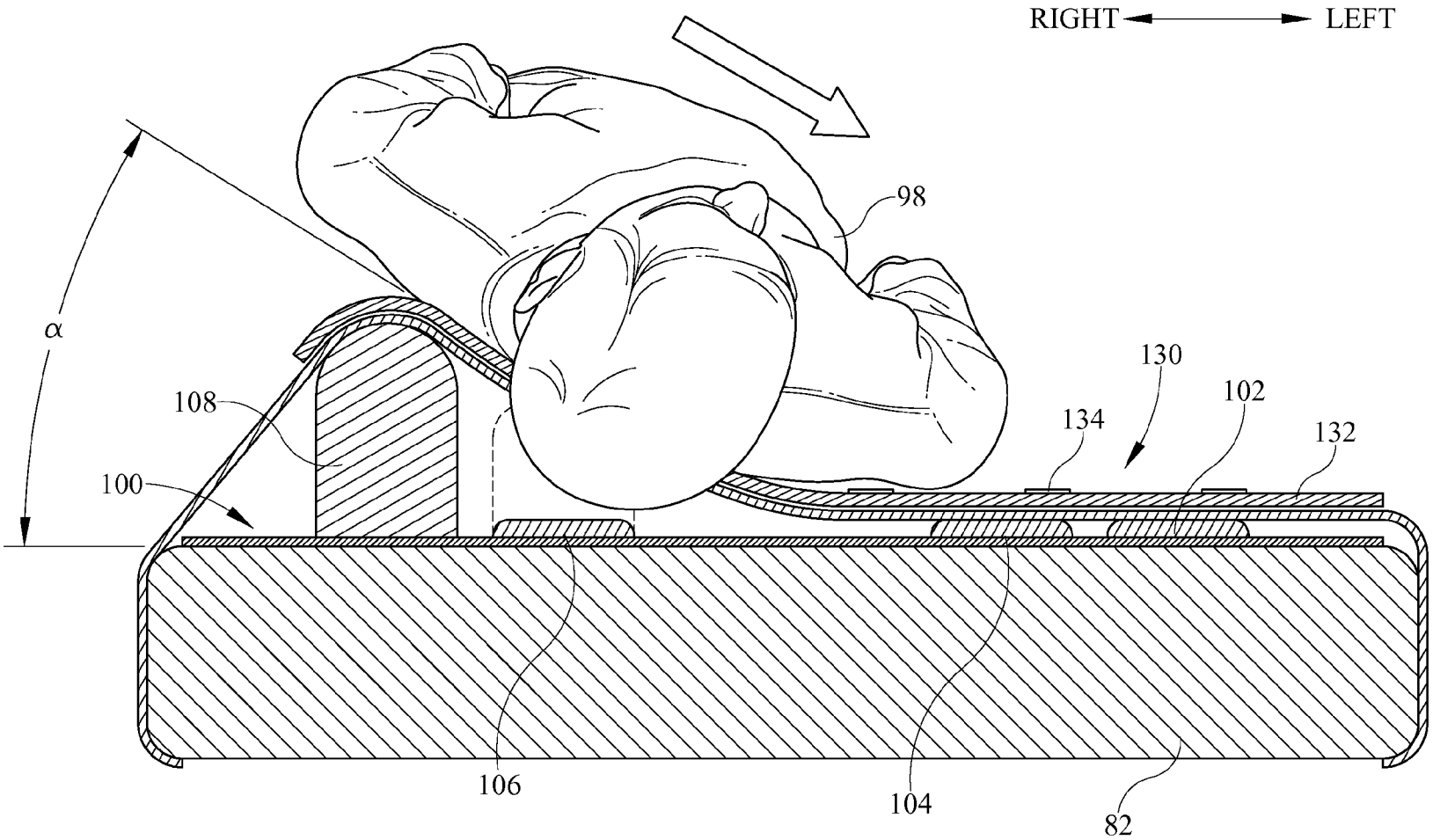
FIG. 12 is a head end elevation view of the bed of FIG. 1 showing a right outboard bladder inflated and also showing a right inboard bladder deflated (solid lines) or inflated less than the outboard bladder to establish an elevation gradient for urging the bed occupant toward the longitudinal center of the bed.

If an occupant position discrepancy is identified, an elevation gradient is established in one of two sectors of the bed. For example if the position discrepancy reveals that the occupant is mispositioned toward one of the right regions NR, SR, then the elevation gradient is established in the right sector 64. Conversely, if the position discrepancy reveals that the occupant is mispositioned toward one of the left regions NL, SL, then the elevation gradient is established in the left sector 62. The gradient is established independently of the frames 22, 24 by inflating one or more selected repositioning bladders 102, 104, 106, 108 such that features of the gradient, such as its direction, magnitude and position, are compatible with moving the occupant from his existing occupant position to, or at least toward, the target position. For example, as seen in FIG. 12, if the position discrepancy reveals that the occupant is mispositioned toward one of the right regions NR, SR, then one of the right repositioning bladders, for example right outboard bladder 108, can be inflated so that the occupant slides gently toward the longitudinal centerline. Optionally, as seen in broken lines in the illustration, the right inboard bladder could be inflated by a lesser amount to better support the occupant. The inflated bladder (or bladders) is then deflated.

The suitability of the occupant's position is then re-evaluated to determine of the occupant has been satisfactorily repositioned. The re-evaluation can be accomplished by repeating the previously described step of identifying whether or not an occupant position discrepancy still exists.

If the position discrepancy is determined to have been corrected, the bed occupant is considered to be suitably positioned for lateral rotation (e.g. turn assist, CLRT, LPR), and the lateral rotation can proceed. However if a position discrepancy persists, the controller commands an appropriate response. One possible response could be to issue an alert advising the caregiver staff that the repositioning attempt was unsuccessful. Another possible response could be to make at least one attempt to remedy the noncorrection of occupant position before issuing an alert. One type of remedial action is to establish an elevation gradient having at least one property (direction, position or magnitude) different than the property of the unsuccessfully applied gradient and then repeating the determining and responding steps. The following paragraphs present examples of persistent position discrepancies and remedial actions that might be appropriate in each case.

Example 1

If an initial discrepancy reveals occupant mispositioning toward one of the right regions NR, SR, and the determination step shows that the occupant remains mispositioned to the right, but to a lesser degree, an appropriate remedial action could be to once again establish an elevation gradient in the right sector 64, but at a location more inboard than the location of the previous gradient. Such a location change can be accomplished by inflating the right inboard bladder 106. In general, if an elevation gradient is only partially effective at repositioning the occupant toward the centerline, establishing a second gradient at a more inboard location may be sufficient to satisfactorily complete the repositioning.

Example 2

If an initial discrepancy reveals occupant mispositioning toward one of the right regions NR, SR, and the determination step reveals little or no change in occupant position, an appropriate remedial action could be to inflate the right outboard bladder a second time, but to a greater elevation, thereby increasing the magnitude of the gradient in an attempt to reposition the occupant.

Example 3

If an initial discrepancy reveals disproportionate loading in, for example, region NR, and the determination step shows satisfactory correction of the disproportionate loading of region NR accompanied by disproportionate loading of region SL, the occupant may have been initially lying obliquely across the bed, for example with his torso atop region NR and his legs atop the region SL. An elevation gradient established in right sector 64, as described above, could have caused a satisfactory repositioning of the body portion lying atop the region NR (i.e. the occupant's torso), but would not be likely to have caused a satisfactory repositioning of the occupant's legs. An appropriate remedial action could be to establish a second gradient in the region SL to reposition the occupant's legs more toward centerline 56. In general, mispositioning of an obliquely oriented patient is corrected by establishing an elevation gradient on one lateral side of the bed followed by establishing a second gradient on the opposite lateral side of the bed (i.e. at a different position) and in the opposite direction (e.g. descending right to left instead of left to right).

In a relatively simple embodiment the controller is designed or configured to use the information from the sensors to identify nothing more than the mere existence of a position discrepancy and to command a preordained, open loop sequence of bladder inflation and deflation (e.g. inflate and deflate the right outboard bladder, then the right inboard bladder, then the left outboard bladder, then the left inboard bladder). The controller can also be programmed to determine if the position discrepancy has been corrected either during the inflation/deflation sequence, in which case the inflation/deflation sequence might be discontinued, or after the entire sequence has been completed. In a more sophisticated embodiment the controller is designed or configured to use the information from the sensors to identify not only the existence of a position discrepancy but also the characteristics of the discrepancy, and to command bladder inflation and deflation to an extent and in a sequence appropriate to the initial characteristics of the discrepancy and taking account of how the characteristics of the discrepancy change in response to operation of the repositioning bladders.

Figure 3:
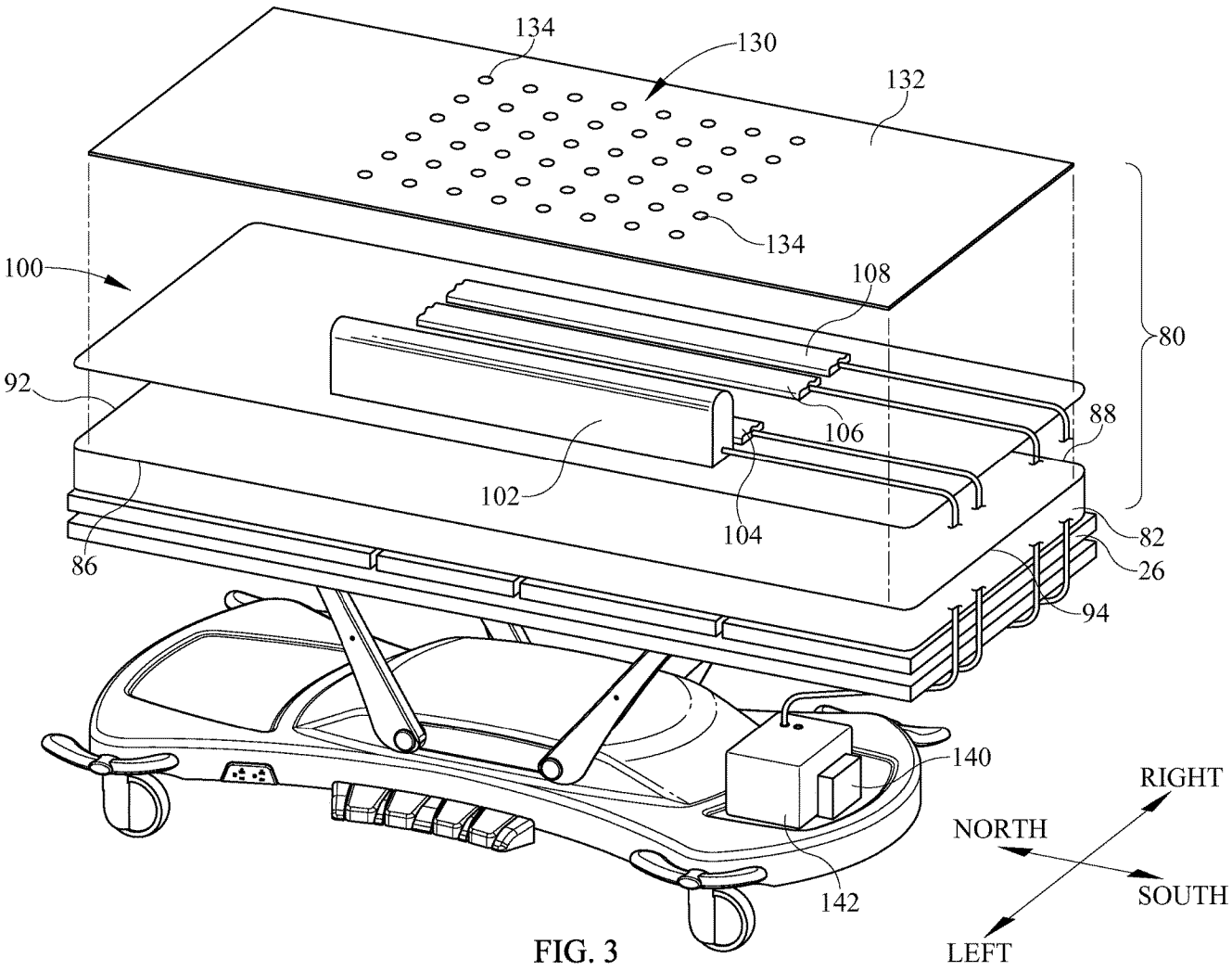
FIG. 3 is an exploded view similar to that of FIG. 1. showing the mattress, the bladder array and a sensor array.
Figure 4:
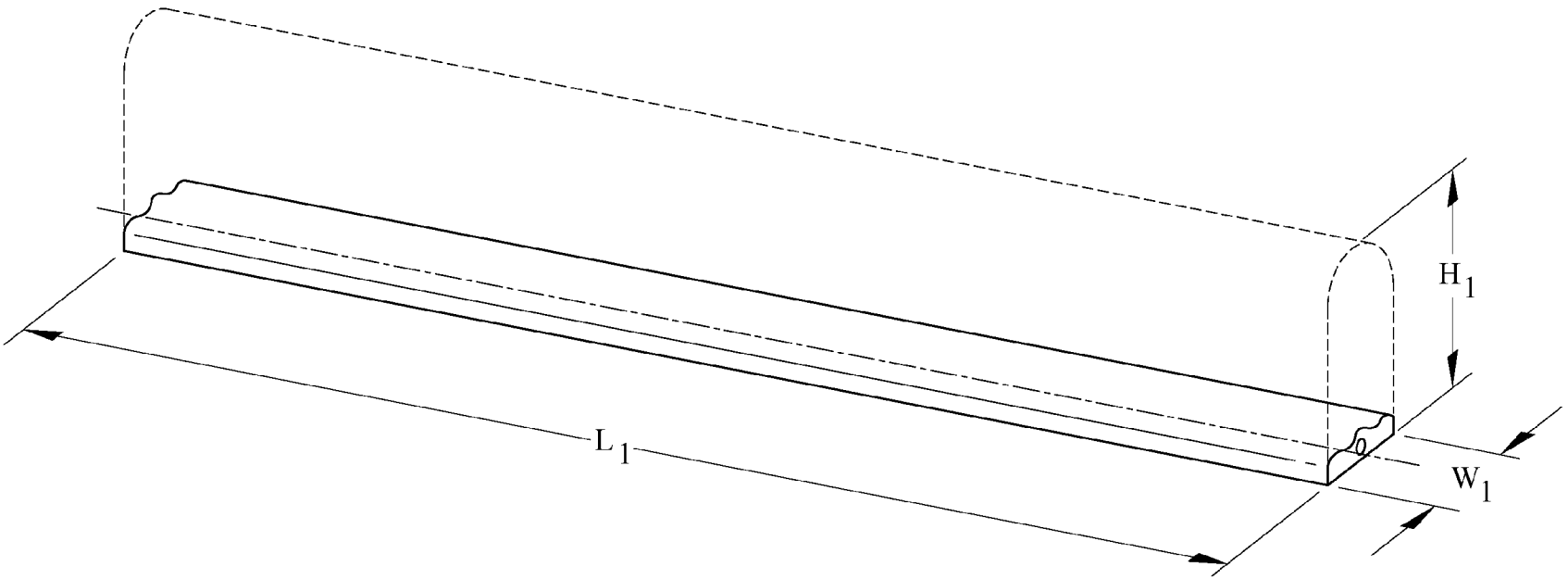
FIG. 4 is a perspective view showing a representative bladder in a deflated state (solid lines) and in an inflated state (broken lines).
Figure 5A:
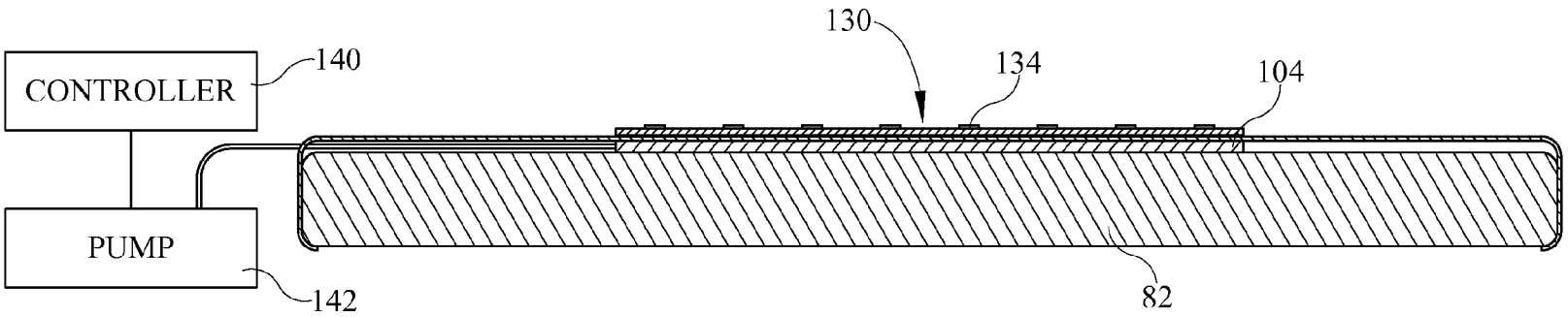
FIGS. 5A and 5B are side elevation views showing representative bladders in the deflated and inflated states respectively.
Figure 5B:
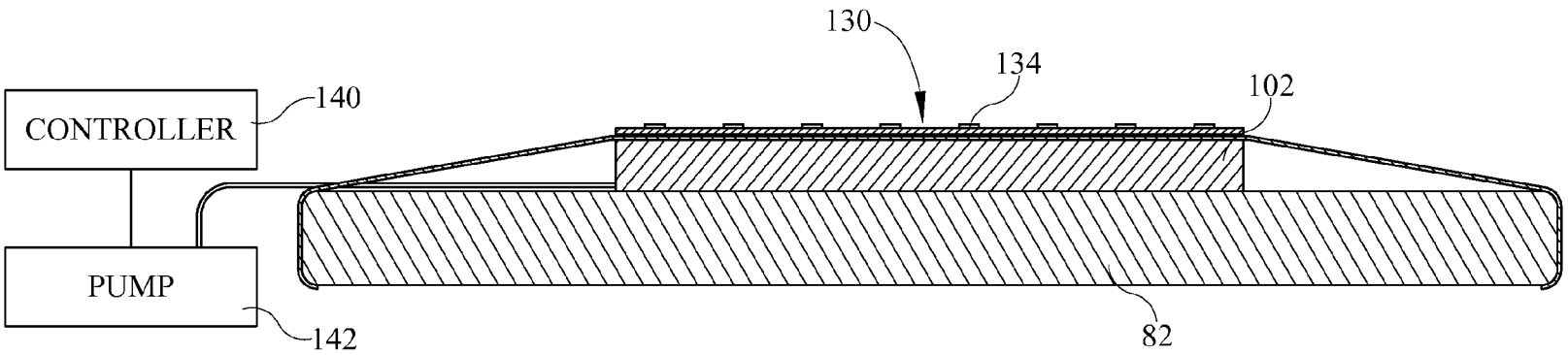

In view of the foregoing description and examples of operation, it is evident that the bladder layer 100 of FIGS. 1-3 can be operated to cause occupant repositioning in the longitudinal direction. The bladder layers 100A, 100B of FIGS. 7-8 can be operated to achieve longitudinal or lateral repositioning, but may not be optimal for repositioning in a direction having both longitudinal and lateral components unless the repositioning in the two component directions is carried out sequentially rather than concurrently. The bladder arrays of FIGS. 9-10 and bladder triplets of FIG. 11 can be operated to achieve longitudinal or lateral repositioning, and may also be better suited than the bladder array of FIGS. 7-8 for concurrent repositioning in both the longitudinal and lateral directions.

Figure 13A:
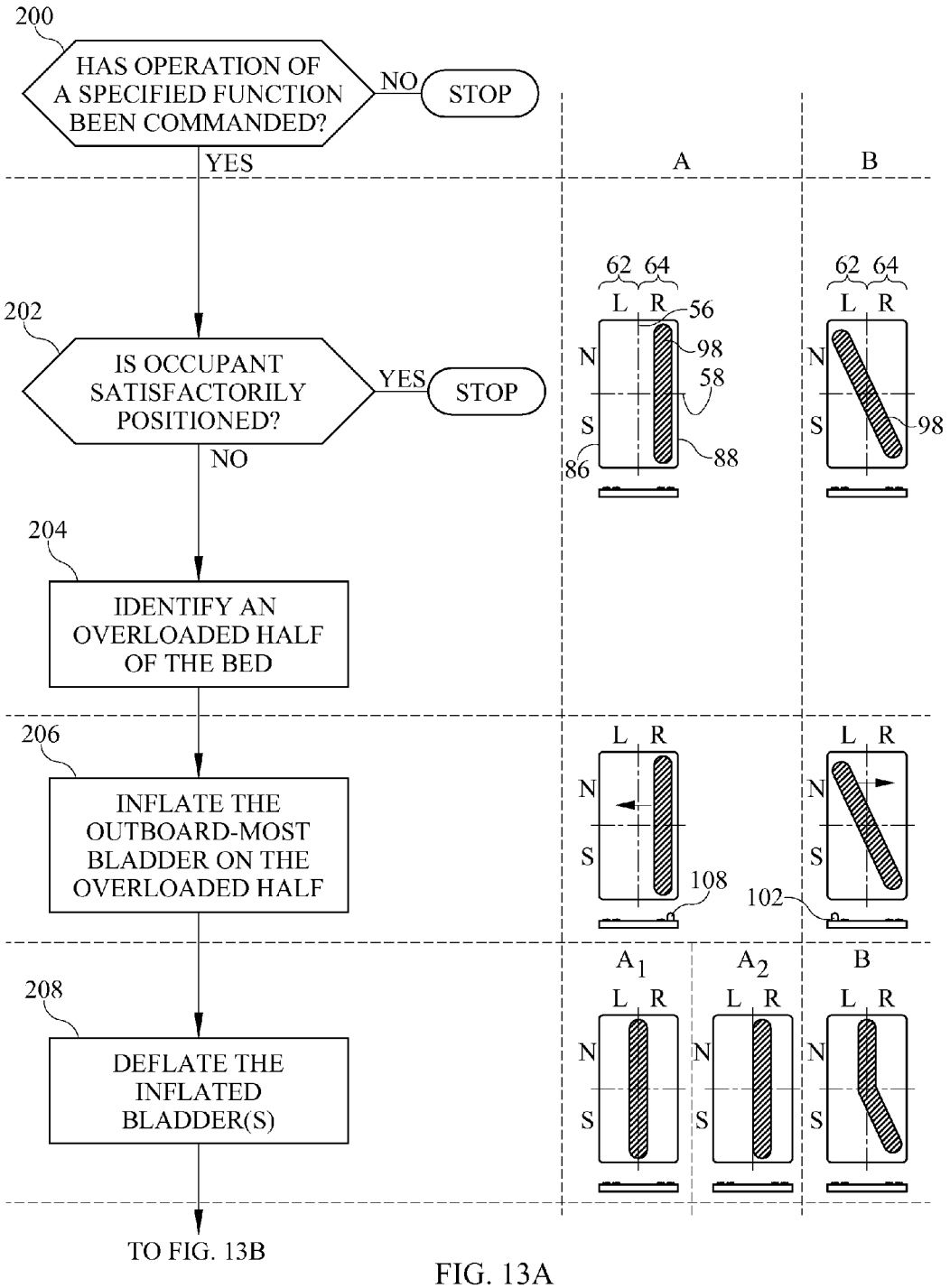
FIGS. 13A-13C show a block diagram illustrating one possible algorithm for operating the bed of FIG. 1, and schematic plan views and end elevation views corresponding to the diagram blocks and showing three examples of the state of the bed and the occupant.
Figure 13B:
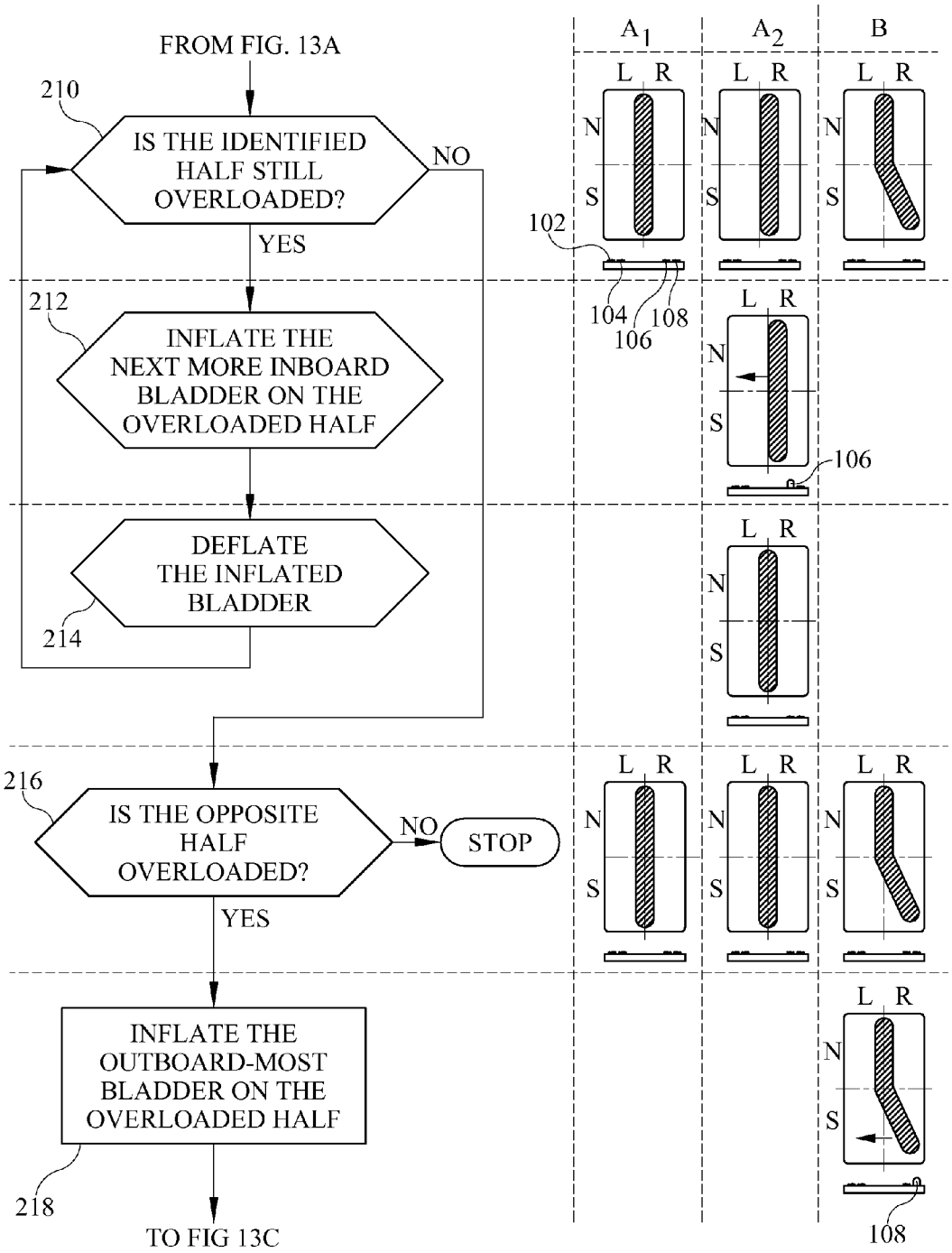
Figure 13C:
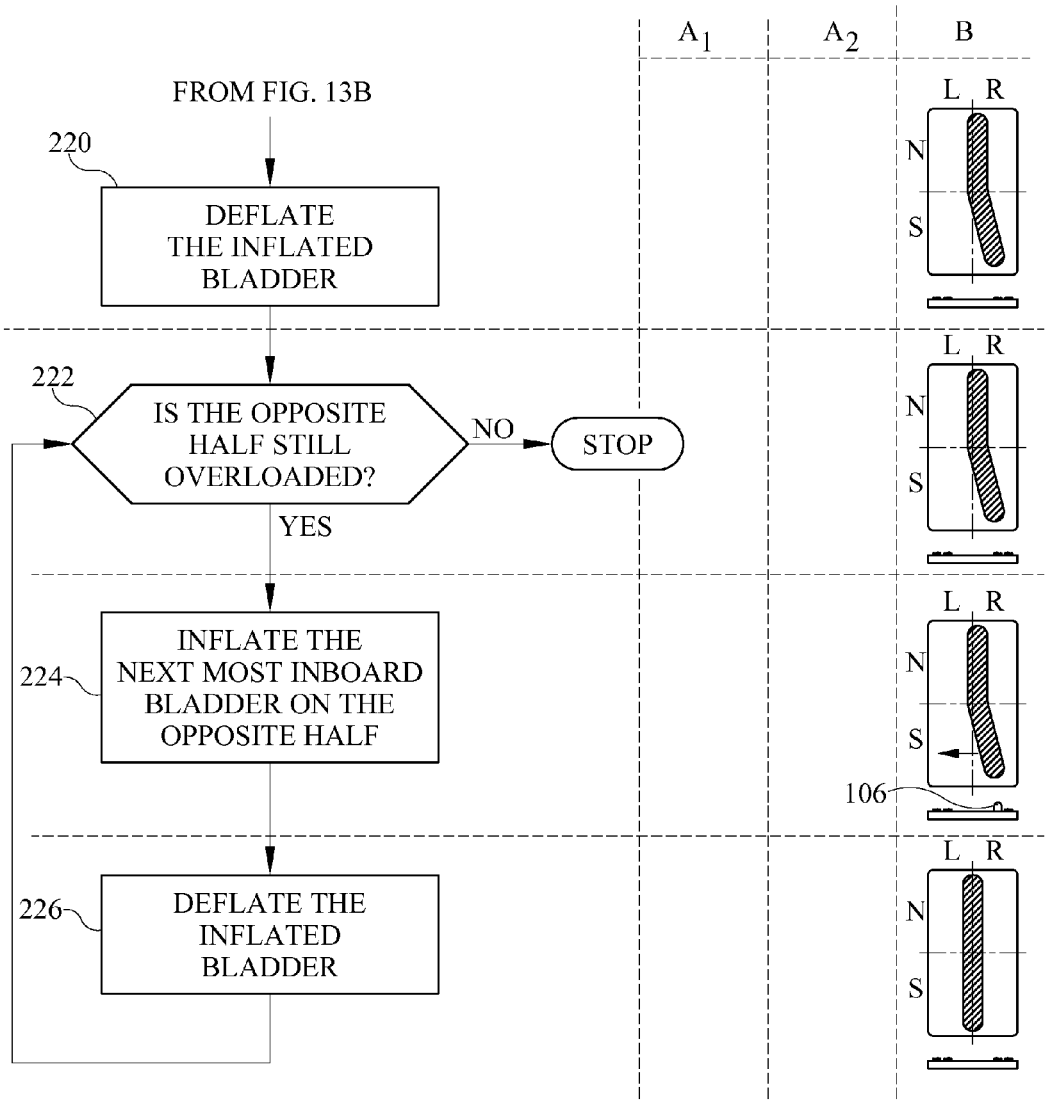

FIG. 13 is a block diagram illustrating one possible algorithm for operating the bed of FIGS. 1-3, i.e. a bed having two longitudinally extending repositioning bladders on each lateral side of the longitudinal centerline. The figure also includes schematic plan views of an occupant 98 lying on the bed and a corresponding schematic end elevation view showing the repositioning bladders 102, 104, 106, 108.

Block 200 determines if a bed function such as one of the lateral rotation functions (turn assist, CLRT, LPR) has been commanded. If so, the algorithm proceeds to block 202 to ensure that the bed occupant is suitably prepositioned before beginning the lateral rotation.

At block 202 the algorithm uses information from the sensor array 130 to determine if the occupant is satisfactorily prepositioned. The criterion for satisfactory positioning could be expressed as a prescribed load distribution among the four regions or quadrants NL, NR, SL, SR. For example satisfactory positioning could correspond to equal loading in each region or to some prescribed nonequal loading such as 30% in region NL, 30% in region NR, 20% in region SL and 20% in region SR. As a practical matter, the criterion for satisfactory load distribution will be subject to a tolerance e.g. ±5% or ±10%. The load distribution corresponding to satisfactory positioning is also a function of whether the sectors 62, 64, 66, 68 are defined by the centerlines 56, 58 or by some other reference such as a longitudinal reference line laterally offset from the longitudinal centerline 56 and/or a lateral reference line longitudinally offset from the lateral centerline 58. If the sensors are pressure sensors the loads can be determined by the product of pressure and area. If the sensors are pressure sensors and the area is assumed to be equal or known to be equal for all the sensors, the pressure readings can be used directly as a surrogate for the actual force. If the occupant is satisfactorily prepositioned, execution of the algorithm ends after block 202 and the lateral rotation can proceed. If not, the algorithm proceeds to block 204. The schematic views show two likely examples of occupant mispositioning. Example A shows the occupant offset to one lateral side of the bed, but nevertheless substantially parallel to edges 86, 88. Example B shows the occupant lying obliquely across the bed with his torso in region NL and his legs in region SR.

At block 204 the algorithm again uses the information from the sensor array to determine which lateral sector 62, 64 of the bed is overloaded. In example A, right sector 64 is overloaded. In example B regions NR and SL are lightly loaded, and regions NL and SR are heavily loaded with region NL being more heavily loaded than region SR. Hence, the algorithm concludes that the left sector 62 is the overloaded sector.

At block 206 the algorithm commands the pump 142 to inflate the outboard-most repositioning bladder on whichever lateral side of the bed is overloaded—the right side in example A and the left side in example B. In example A the bladder inflation causes the occupant to slide leftwardly toward longitudinal centerline 56 (as depicted in FIG. 12). In example B the bladder inflation causes the upper portion of the occupant's body to slide rightwardly toward centerline 56.

At block 208 the algorithm commands the pump 142 to deflate the inflated bladder. The schematic views show two possible outcomes for example A and one possible outcome for example B. In example A1 the occupant has become substantially laterally aligned with centerline 56. In example A2 the occupant has been moved closer to centerline 56, but is still off-center. In example B the upper portion of the occupant's body has become substantially laterally aligned with centerline 56, but the lower portion of the occupant's body is still off-center.

At block 210 the algorithm uses information from the sensor array to determine if the bed sector that had previously been identified as being overloaded is still overloaded. In examples A1 and B the identified sector (right sector 64 in example A1; left sector 62 in example B) is no longer overloaded. As a result, the algorithm proceeds to block 216. In example A2 the identified sector remains overloaded. As a result, algorithm proceeds to block 212.

At block 212 the algorithm commands the pump to inflate the next more inboard bladder, i.e. bladder 106, on the overloaded side of the bed. The bladder inflation causes the occupant to slide leftwardly and toward centerline 56. At block 214 the algorithm then deflates the inflated bladder and returns to block 210 to again assess whether the bed sector that had previously been identified as being overloaded is still overloaded. In the example the algorithm concludes that the identified sector is no longer overloaded. As a result, the algorithm proceeds to block 216. It is envisioned that block 210 would be executed no more than n times and that blocks 212 and 214 would be executed no more than n−1 times, where n is the quantity of bladders on each side of the bed (n=2 in the present examples). If, after n executions at block 210, the identified sector is still overloaded, the algorithm could be programmed to cease execution and issue an alert that the repositioning attempt was unsuccessful. Alternatively the algorithm could proceed to block 216 and issue an alert that the repositioning attempt was less than completely successful.

At block 216 the algorithm determines if the opposite lateral side of the bed is overloaded. The opposite side is the side not identified as being overloaded at block 204. In examples A1 and A2 the algorithm determines that the opposite side is not overloaded. As a result, execution of the algorithm ends. In example B the algorithm determines that the opposite side remains overloaded due to the load in region SR. As a result, the algorithm proceeds to blocks 218-226, which repeat the operations of blocks 206-214 on the opposite side of the bed. Once again, the algorithm would be configured to observe a limit on the number of iterations through blocks 222-226 and to issue an appropriate alert if the repositioning attempt is completely or partially unsuccessful.

In the above example, the prepositioning algorithm is executed automatically in response to a specified bed function having been commanded (block 200). Examples of the specified functions include turn assist, Continuous Lateral Rotation Therapy and Lateral Pressure Relief. Alternatively the algorithm need not include block 200. Instead, the bed could include a prepositioning control button or switch that the occupant or a caregiver could use to initiate execution of the algorithm at will.

The above example is presented in the context of a bed, such as that of FIGS. 1-3, having longitudinally extending repositioning bladders. This arrangement is believed to be especially useful for repositioning an occupant laterally. However the repositioning method disclosed herein is also applicable to beds, such as that shown in FIG. 6, having at least two laterally extending repositioning bladders with an equal number of bladders in each of two longitudinally adjacent sectors of the bed. The lateral arrangement is believed to be especially useful for repositioning an occupant longitudinally. Longitudinal repositioning may be advisable prior to making a change to the deck profile angles $\alpha$, $\beta$, $\theta$, (FIG. 1A) particularly angle $\alpha$ of torso section 28. An example algorithm for the lateral bladder arrangement would be similar to the one presented above in the context of the longitudinal bladder arrangement. Multidirectional repositioning capability can be imparted to a bed by using two orthogonal bladder arrays 100A, 100B (FIGS. 7-8), a matrix of cell-like bladders (FIGS. 9-10) or obliquely oriented bladders (FIG. 11). For the matrix configuration of FIGS. 9-10 it is envisioned that the bladders in one or more of the A groups would be inflated first, followed by bladders in one or more of the D groups (i.e. from the corners of the bed toward the center) until the occupant had been satisfactorily repositioned.

Bed configurations that employ only one bladder on each side of the bed or that employ more than two bladders on each side of the bed are also envisioned. In the event that three or more bladders are used the remedial action taken in response to an uncorrected position discrepancy would involve inflating the outboard-most bladder followed by successive cycles of inflating the next more inboard bladder and deflating it's neighboring next more outboard neighbor until the inboard most bladder has been inflated and deflated.

An additional operational feature that may be attractive is to slightly inflate one of the bladders on the side of the bed opposite the side that has been identified as being overloaded. The slight inflation of the opposing bladder can help prevent the occupant from sliding past the target position as his position is being adjusted. Such inflation can also be used subsequent to the repositioning to ensure that the subsequent lateral rotation does not force the occupant toward the "downhill" edge of the bed and, to the extent the occupant rests against the bladder, to help reduce shear forces acting on the occupant's skin.

The repositioning bladders described above are dedicated to occupant positioning, i.e. they serve no other purpose. However as already noted, some beds employ base mattresses in which inflated air bladders contribute to long-term occupant support. In such beds it may be possible to use these support bladders to carry out occupant repositioning, in addition to carrying out their long-term support function, rather than using dedicated repositioning bladders. In addition, the repositioning bladders, or a subset of them, can also be used to apply rotation therapies such as CLRT and LPR in addition to serving as repositioning bladders With the structure and operation of the occupant support having now been described, the factors that influence the locations of the repositioning bladders, their dimensions, and the inflation sequence (outboard to inboard) can now be appreciated. The outboard to inboard inflation sequence helps drive the occupant toward the center of the bed (favorable) rather than toward the edges (unfavorable).

The centerline of the outboard-most bladder should be outboard of the center of mass of the bodies of the vast majority of the population. The occupant most at risk of being repositioned incorrectly is the smallest patient. Anthropometric data (C. Harrison, K. Robinette, "CAESAR: Summary Statistics for the Adult Population (ages 18-65) of the United States of America" published by the Human Effectiveness Directorate, Wright Patterson AFB under a Cooperative Research Agreement with SAE International AFRL-HE-WP-TR-2002-170) shows that 99% of the adult male and female population have a total body width across the shoulders of 13.62 inches or greater. In order to guard against the possibility that the outboard-most bladder, when fully inflated, will drive the occupant away from the centerline 56, the centerline of the outboard-most bladder should be spaced from the edge of the mattress by distance of no more than half of their shoulder width to ensure that the peak of the bladder, when fully inflated, is between the midline of the body and lateral edge 86, 88 of the bed. This sets the centerline of the outboard-most bladder no more than about 6.8 inches (17 cm) from the edge of the mattress. The next most inboard bladder may laterally about its more outboard neighbor, or may be spaced from it by, for example, a 1 inch (2.5 cm) spacing as seen in FIG. 2. The inboardmost bladder should be far enough from the centerline 56 that, when inflated, it does not drive the occupant away from centerline 56. The length of the bladders should be about 30 inches (76 cm) so that the lifting force exerted by the bladder acts in the region from the occupant's hips to the base of the occupant's neck, which is the region where most of the occupant's weight is present.

Regarding the height of an inflated bladder, it is believed that an inclination of as much as 40° may be required to ensure that the occupant slides across the mattress. The above referenced CAESAR database reveals that 99% of the prospective occupants have a shoulder width of about 22.7 inches (58 cm). Assuming the centerline of the bladder is at the extreme outer edge of a supine bed occupant, the occupant and the inflated bladder approximate the hypotenuse and one side of a right triangle. To achieve 40° of inclination, the bladder would therefore have to project about 22 sin 30° or 14.6 inches (37 cm) above its uninflated height. If the bladder were closer to the center line of the body, or the body were less than 22.7 inches wide the 14.6 inch tall bladder would achieve an inclination greater than 40°. Most occupants will not require bladder inflation to the full extent of 14.6 inches. It is believed that inclinations of about 60° or more may cause the occupant to roll rather than slide. One possible technique to encourage occupant sliding at modest inclinations is to oscillate the bladder thereby creating a vibration intended to break the static friction and encourage sliding. Prior to deflation the bladders can be pulsed to relieve shear in a manner similar to that described in pending U.S. patent application Ser. No. 12/704,600 filed on Feb. 12, 2010 and entitled "Method and Apparatus for Relieving Shear Induced by an Occupant Support", the contents of which are expressly incorporated herein by reference.

A bladder width of about 4 inches (10 cm) offers the designer the option to include more than one bladder on each side of the bed while providing adequate spacing between the inboard-most bladder and the centerline.

For laterally extending bladders, such as bladders 150, 152, 154, 160, 162, 164 of FIG. 6, the distance from the laterally extending centerline of the outboard-most (northmost or southmost) fully inflated bladder should be outboard of the center of mass of the smallest occupant's body when the occupant is positioned as far northward or southward as possible and is curled into a position similar to a fetal position. The above referenced CAESAR database reveals that in the seated position, which approximates the fetal position, 99% of adults are at least about 35 inches (89 cm) in length. Assuming the occupant's mass is distributed approximately uniformly along his or her length, the centerline of the outboard-most bladders should be no more than half this distance, or approximately 17.5 inches (44 cm) from the ends of the bed. The inboardmost bladder should be far enough from centerline 58 that, when inflated, it does not drive the occupant away from centerline 58.

Although this disclosure refers to specific embodiments, it will be understood by those skilled in the art that various changes in form and detail may be made without departing from the subject matter set forth in the accompanying claims.

We claim:

1. An occupant support comprising:

a mattress;

at least one layer of repositioning bladders;

a sensor array;

a controller capable of receiving information from the sensor array, identifying suboptimal positioning of an occupant of the occupant support as a function of the received information and also capable of issuing commands in response to the identification of suboptimal positioning; and a pump capable of inflating selected repositioning bladders in response to the issued commands;

the issued commands and bladder inflation being such as to establish an elevation gradient compatible with moving the occupant laterally and/or longitudinally across the support surface from an existing occupant position to a target position;

wherein the repositioning bladders are dedicated to lateral and/or longitudinal repositioning of the occupant across the support surface and are equally distributed between two laterally adjacent sectors with at least one bladder in each sector.

2. The occupant support of claim 1 wherein the mattress is constructed of foam, at least two support bladders, or both.

3. The occupant support of claim 1 wherein the controller commands inflation and deflation of the bladders to an extent and in a sequence responsive to changing characteristics of the suboptimal positioning.

4. An occupant support comprising:

a mattress;

at least one layer of repositioning bladders;

a sensor array;

a controller capable of receiving information from the sensor array, identifying suboptimal positioning of an occupant of the occupant support as a function of the received information and also capable of issuing commands in response to the identification of suboptimal positioning; and a pump capable of inflating selected repositioning bladders in response to the issued commands;

the issued commands and bladder inflation being such as to establish an elevation gradient compatible with moving the occupant laterally and/or longitudinally across the support surface from an existing occupant position to a target position;

wherein the repositioning bladders are dedicated to lateral and/or longitudinal repositioning of the occupant across the support surface and are equally distributed among two longitudinally adjacent sectors with at least one bladder in each sector.

5. The occupant support of claim 4 wherein the mattress is constructed of foam, at least two support bladders, or both.

6. The occupant support of claim 4 wherein the controller commands inflation and deflation of the bladders to an extent and in a sequence responsive to changing characteristics of the suboptimal positioning.

7. An occupant support comprising:

a mattress;

at least one layer of repositioning bladders;

a sensor array;

a controller capable of receiving information from the sensor array, identifying suboptimal positioning of an occupant of the occupant support as a function of the received information and also capable of issuing commands in response to the identification of suboptimal positioning; and a pump capable of inflating selected repositioning bladders in response to the issued commands;

the issued commands and bladder inflation being such as to establish an elevation gradient compatible with moving the occupant laterally and/or longitudinally across the support surface from an existing occupant position to a target position;

wherein the repositioning bladders are dedicated to occupant repositioning across the support surface and comprise a matrix of cells laterally and longitudinally distributed in a common layer.

8. The occupant support of claim 7 wherein the mattress is constructed of foam, at least two support bladders, or both.

9. The occupant support of claim 7 wherein the controller commands inflation and deflation of the bladders to an extent and in a sequence responsive to changing characteristics of the suboptimal positioning.

10. An occupant support comprising:

a mattress;

at least one layer of repositioning bladders comprising a first layer of longitudinally extending repositioning bladders and a second layer of laterally extending repositioning bladders;

a sensor array above the layers of repositioning bladders;

a controller capable of receiving information from the sensor array, identifying suboptimal positioning of an occupant of the occupant support as a function of the received information and also capable of issuing commands in response to the identification of suboptimal positioning; and a pump capable of inflating selected repositioning bladders in response to the issued commands;

the issued commands and bladder inflation being such as to establish an elevation gradient compatible with moving the occupant laterally and/or longitudinally across the support surface from an existing occupant position to a target position.

11. The occupant support of claim 10 wherein the mattress is constructed of foam, at least two support bladders, or both.

12. The occupant support of claim 10 wherein the controller commands inflation and deflation of the bladders to an extent and in a sequence responsive to changing characteristics of the suboptimal positioning.

* * * * *